United States Patent [19]

Strom et al.

[11] 4,009,836

[45] Mar. 1, 1977

[54] MATERIAL REDUCING MACHINE

[75] Inventors: Sven B. Strom, St. Louis; Donald F. Graveman, St. Charles, both of Mo.

[73] Assignee: American Pulverizer Company, St. Louis, Mo.

[22] Filed: June 30, 1975

[21] Appl. No.: 591,462

[52] U.S. Cl. ..... 241/73; 241/89.1; 241/189 A; 241/285 B

[51] Int. Cl.[2] ..... B02C 13/284

[58] Field of Search ..... 241/73, 88.4, 89.1, 241/89.2, 89.3, 189 R, 189 A, 285 A, 285 B

[56] References Cited

UNITED STATES PATENTS

| | | | |
|---|---|---|---|
| 1,621,938 | 3/1927 | Liggett | 241/73 |
| 2,149,571 | 3/1939 | Battey | 241/189 A UX |
| 2,471,068 | 5/1949 | Keiper | 241/89.1 X |
| 2,482,279 | 9/1949 | Lemmon | 241/189 R X |
| 3,480,214 | 11/1969 | Wageneder | 241/285 A UX |
| 3,722,805 | 3/1973 | Strom | 241/73 |
| 3,899,139 | 8/1975 | Okada | 241/73 X |

*Primary Examiner*—Roy Lake
*Assistant Examiner*—Howard N. Goldberg
*Attorney, Agent, or Firm*—Gravely, Lieder & Woodruff

[57] ABSTRACT

A material reducing machine has a housing and a reversible rotor which revolves in the housing. On each side of the rotor the housing carries wear plates which pivot such that their lower ends will move inwardly, thus enabling the wear plate to serve as a deflecting vane for diverging windage away from the feed opening of the housing. Only the vane on the ascending side of the rotor is opened, the other being closed to serve as a wear and breaking surface against which the material is hurled. The grate beneath the rotor is in two sections with the juncture between the sections being directly below the axis of the rotor. At this juncture, the sections are provided with intermeshing teeth to prevent a gap from forming in the grate. The grate sections are supported on cages which pivot at their upper ends and are moved upwardly and downwardly at their lower ends by cams to adjust the spacing between the grate and rotor.

7 Claims, 4 Drawing Figures

F
A
H
R
2
4
6
10
12
14
16
18
20
22
30
40
42
52
54
56
68
70
72
110
112
114
116
118
124
130
138
140
150

H
O
R
C
G
2
3
4
6
10
12
14
16
18
30
32
34
36
40
42
44
46
48
50
52
58
60
62
80
82
84
88
110
112
114
116
118
120
122
124
126
127
128
130
132
134
136
142
144
152

MATERIAL REDUCING MACHINE

BACKGROUND OF THE INVENTION

This invention relates to machines for reducing material such as refuse to smaller size.

In order to incinerate municipal refuse efficiently and with a minimum amount of polution, the refuse should first be reduced to a relatively small size. Shredding machines are used for this purpose, but the shredding machines of current manufacture possess several major disadvantages. For example, the spacing between the grate and the circle described by the hammers is very critical insofar as efficiency of operation and product size is concerned. Some machines have adjustable grates, but the adjustment mechanisms are difficult to operate. Moreover, the grates of the machines are usually pivoted at one end and raised or lowered at the opposite end. This results in substantial variances in spacing. In particular, the pivoted end moves very little, whereas the opposite end moves a considerable distance for any given adjustment.

Reversible machines are desirable from the standpoint that they need not be disassembled to take advantage of sharper cutting edges on the opposite sides of the hammers. The rotor is merely reversed to achieve this end. Whereas, unidirectional machines are usually designed such that the feed opening is offset to one side of the rotor so that the windage developed by the rotor does not significantly disrupt the incoming material, reversible machines have the feed opening centered directly over the rotor. Moreover, unidirectional machines are sometimes provided with vanes to divert the windage from the feed opening. In reversible machines vanes are not employed since a vane suitable for one direction of rotation is detrimental to the other direction. Because municipal refuse contains much light weight material such as paper, which is easily carried by windage, reversible machines have found little application in the refuse field.

SUMMARY OF THE INVENTION

One of the principal objects of the present invention is to provide a reducing machine which is ideally suited for reducing a wide variety of material including refuse. Another object is to provide a reducing machine having a grate which is adjustable with considerable precision and with little variance along the hammer circle in comparison to conventional machines. A further object is to provide a machine of the type stated which is reversible. An additional object is to provide a reversible reducing machine having windage diverting vanes which are effective for both directions of rotation. Still another object is to provide a simple and highly reliable mechanism for adjusting the grate of a reducing machine. These and other objects and advantages will become apparent hereinafter.

The present invention is embodied in a reversible reducing machine having wear plates on each side of its rotor and means for creating diversion channels along the wear plates to divert windage outwardly. The invention also resides in a machine having grate sections which are adjustable relative to one another. The two grate sections have intermeshing teeth to prevent a gap from forming between the two sections. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
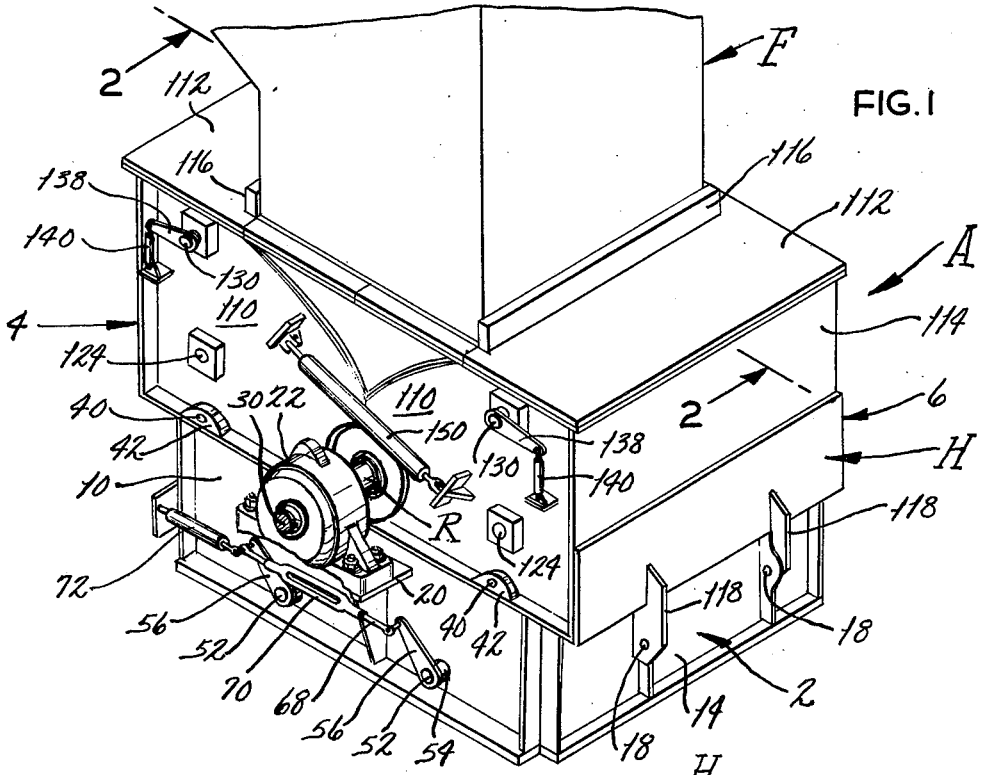
FIG. 1 is a perspective view of the reducing machine of the present invention.

Referring now to the drawings (FIGS. 1 and 2), a material shredding or reducing machine A includes a housing H which carries a rotor R, the major portion of which revolves within the housing H above a grate G for shredding refuse or other material introduced into the machine A through a feed hopper F. The feed hopper F leads to a feed opening O in the top of the housing H, and has somewhat triangular side sections which extend downwardly past the sides of the feed opening O.

The housing H consists of three basic components (FIG. 1), namely, a fixed base 2 and two top cover sections 4 and 6 which are hinged to the base 2 and move between open and closed positions with respect to the rotor R. When the cover sections 4 and 6 are in their closed position, they are located directly over the base 2 and adjacent each other, and furthermore completely enclose the rotor R (FIG. 2). On the other hand, when either of the cover sections 4 and 6 is in its open position it is located generally outwardly from base and the rotor R is exposed sufficiently to remove it from the housing H. The base 2 includes parallel sidewalls 10 and parallel end walls 12 and 14 joined together in a rectangular configuration. The bottom of the base 2 is open, and forms a discharge opening 16. The end walls 12 and 14 are reinforced with ribs and some of these ribs are enlarged to receive hinge pins 18 about which the upper cover sections 4 and 6 pivot.

Projected outwardly from each sidewall 10 is a mounting plate 20 (FIGS. 1 and 3) to which a pillow block 22 is bolted. The pillow blocks 22 in turn support the rotor R enabling it to rotate relative to the housing H. Directly below the plate 20, the sidewalls 10 are provided with viewing ports 24 which are usually covered.

The rotor R includes (FIGS. 2 and 3) a rotor shaft 30 which extends through and is journaled in the bearings of the pillow blocks 22. Between the sidewalls 10 of the base 2 the shaft 30 is fitted with a plurality of rotor disks 32 which are spaced apart near their peripheries. The disks 32 in turn have hammer shafts 34 extended through them, with the shafts 34 being parallel to the rotor shaft 30 and spaced at 90° intervals around it. The hammer shafts 34 are also extended through hammers 36 which are in the spaces between the disks 32. Thus, the hammer shafts 34 retain the hammers 36 in the rotor R. The hammers 36 are free to swing to and fro on the shafts 34 and normally project radially outwardly under the centrifugal force created by the revolving rotor R. When so disposed, the hammers 36 describe a hammer circle C (FIG. 2). Each hammer 36 has a pair of cutting edges, one of which leads and the other of which trails for a given direction of rotation. One end of the rotor shaft 30 is connected to a suitable motor (not shown) for turning the rotor R.

On each side of the hammer circle C, a pivot shaft 40 extends completely across the base 2, and the ends of the shafts 40 are received in brackets 42 which project upwardly from the upper rim of the sidewall 10. The shafts 40 are parallel to one another as well as to the rotor shaft 30. Each shaft 40 forms part of a separate cage 44 and 46 (FIG. 2), which in addition includes a pair of arcuate support members 48 located outwardly from the hammer circle C and extended downwardly adjacent to the sidewalls 10. Indeed, the arcuate support members 48 of the one cage 44 extend toward corresponding support members 48 on the other cage 44. The inner edges of support members 48 are generally concentric with the hammer circle C, but have a somewhat greater radius. While the upper ends of the support members 48 are confined by the pivot shafts 40, the lower ends are confined by adjusting mechanisms 50.

A separate adjusting mechanism 50 exists for each cage 44 and 46, but the two mechanisms 50 are practically identical and hence only the mechanism 50 for the left cage 44 will be described. That mechanism includes an adjusting shaft 52 (FIGS. 2 and 3) which extends completely across the base 2 and has its ends journaled in sleeve bearings 54 (FIG. 3) secured to the sidewalls 10 of the base 2. The shaft 52 is long enough to extend slightly beyond one of the bearings 54 and this end of the shaft 52 is fitted with an actuating arm 56 (FIG. 1) which projects generally upwardly. Each of the supporting members 48 for the cage 44 has an elongated aperture 58 (FIG. 2) through which the adjusting shaft 52 extends, and these apertures are elongated in the direction perpendicular to a line interconnecting the axes of the two shafts 40 and 52 so that the lower ends of the support members 48 may move inwardly and outwardly notwithstanding the fact that the shaft 52 passes through them. Next to the inside faces of each support member 46, the cage adjusting shaft 52 is fitted with a cam 60 (FIGS. 2 and 3) which is circular but is positioned eccentric to the shaft 52. The size, eccentricity, and angular positioning of the two cams 60 on the shaft 52 are identical.

Contacting the periphery of each cam 60 are two cam followers 62 (FIG. 2) which are mounted in fixed positions on the support members 48. Each follower 62 includes a shoulder bolt which threads into the support member 48 and a follower wheel with needle bearings being interposed between the wheel and bolt to enable the wheel to rotate easily about the axes of the bolt. When the support members 48 are positioned such that the adjusting shaft 52 is located midway between the ends of the elongated apertures 58 in those members 48, the center of curvature for the eccentric cams 60 should be between about 25° and 35° (angle *a*) below the axis of the shaft 52 and preferably 30°, the angle being measured about the axis of the shaft 52 and from the horizontal. Moreover, the uppermost cam follower 62 for each support member 46 should be located directly above the axis for the shaft 52, whereas the other follower 62 should be located 145° to 155° (angle *b*) and preferably 150° therefrom, the angle being measured about the axis for the adjusting shaft 52. The angle is measured in the direction which places the lower follower 62 on the same side of the axis of the shaft 52 as the eccentrically located center of the cam 60. With the cam 60, followers 62, and elongated apertures 58 so disposed, the support members 48 are confined at their lower ends and cannot pivot in either direction about the pivot shaft 40. However, if the cage adjusting shaft 52 is turned the eccentric cams 60 will move the lower ends of the supporting members 46 upwardly or downwardly, depending on the direction of rotation for the shaft 52. No binding will occur between the followers 62 and the cam 60 irrespective of the position of the shaft 52 within the elongated aperture 58 and furthermore one follower 62 is always located close to and above the cam 60, while the other follower 62 is always located close to and below the cam 60, thus preventing movement of the cage 44 when the shaft 52 is at rest.

The cam 60 for the cage 46 possess the same configuration as the cams 60 for the cage 44, but are postioned on their adjusting shaft 52 with their eccentrically located centers located on the opposite side of the adjusting shaft 52 (FIG. 2). Thus, one set of cams 60 will be offset toward the center of the machine A while the other set of cams 60 will be offset away from the center of the machine A. Consequently, the shafts 52 rotate in the same direction to lower their respective cages 44 and 46 and to raise their respective cages 44 and 46.

The two actuating arms 56 are joined by a connecting link 68 (FIG. 1) which contains a turnbuckle 70. The connecting link 68 causes the two shafts 52 to rotate in unison and in the same direction, whereas the turnbuckle 70 enables the one adjusting shaft 52 to be adjusted against the other shaft 52 so that both cages 44 and 46 are at the same elevation. The actuating arm 56 for the cage 46 is connected to a hydraulic cylinder 72 which moves that arm 56 as well as the other arm 56.

The two cages 44 and 46 support the grate G (FIG. 2) which is actually two grate sections 80 and 82, the former of which rests on the cage 44 while the latter rests on the cage 46. The two grate sections 80 and 82 are arcuate, having their inwardly presented surfaces in close proximity to the hammer circle C, and in combination extend for about 165° beneath the hammer circle C. Thus, the cages 44 and 46 constitute mounting means for positioning the two grate sections 80 and 82 along generally the lower half of the hammer circle C. Each grate section 80 and 82 comprises a plurality of grate bar panels 84 located side-by-side with the ends of the panels 84 being on the arcuate supporting members 48.

Each grate bar panel 84 is a separate casting, preferably of manganese steel, and includes end portions 86 (FIG. 3) which are contoured to conform to and rest on the upper surfaces of the arcuate support members 48. The end portions 86 are connected by a pair of longitudinal ribs 88 (FIG. 4) which are spaced apart and traverse the interior of the base 2. The two ribs 88 in turn are joined by intermediate connectors 90 so as to form a series of rectangular openings 92 in the grate bar 84. Projecting outwardly in the circumferential direction from each rib 88 are spacers 94 which are offset in the longitudinal direction from the connectors 90. The spacers 94 of adjacent grate bar panels 84 abut at their ends so as to form more rectangular openings 96 between adjacent panels 84. The openings 96, however, are offset in the longitudinal direction from the openings 92, due to the offset of the spacers 94, and this offset prevents grooves from being worn into the grate sections 80 and 82 as the hammers 36 move over them. This feature is more completely described in U.S. Pat. No. 3,722,805. The end portions 86 of adjacent grate panels 84 likewise abut.

Figure 4:
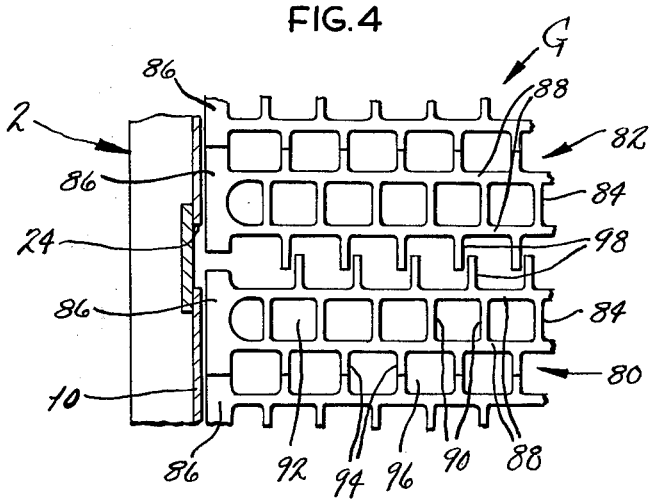
FIG. 4 is a fragmentary sectional view taken along line 4—4 of FIG. 3 and showing the grate at the juncture between the two sections thereof.

All of the grate bar panels 84 for the two grate sections 80 and 82 are the same except for the lowest grate bar panel 84 for each grate section 80 and 82. These grate bar panels 84, instead of having abutting spacers 94 on their ribs 88 facing the center of the base 2, have intermeshed teeth 98 (FIG. 4). In other words, the teeth 98 of the lowermost panel 84 of the grate section 80 are offset from the teeth 98 of the lowermost panel 84 of the grate section 82. Moreover, the teeth 98 of the one panel 84 project beyond the teeth 98 of the other panel 84. This prevents a gap from developing between the two grates 80 and 82 when they are lowered.

The grate bar panels 84 are retained in place by arcuate side liners 100 (FIG. 3) which extend over their end portions 86. These liners 100 are attached to arcuate support members 48 and hence the liners 100 are carried on the cages 44 and 46 and move upwardly and downwardly with them. The liners 100 furthermore are located to the sides of the endmost hammers 36 on the rotor R and protect the sidewalls 10 of the housing base 2 from material impelled by the hammers 136.

As previously noted the two cover sections 4 and 6 are normally in a closed position in which they enclose the rotor R and are located against opposite sides of the feed hopper F. However, they can pivot outwardly about the axes of the hinge pins 18 to open positions in which they are generally beyond the base 2 and the rotor R is exposed. Two two cover sections 4 and 6 are identical and therefore only the section 4 will be described in detail.

The cover section 4 includes sidewalls 110 (FIG. 1) which align with the sidewalls 10 of the base 2 and extend upwardly therefrom. The sidewalls 110 have curved upper margins which are disposed adjacent to the lower margins of the sidewalls of the feed hopper F which are also curved. The curvature is such that the margins are concentric about the axis of the hinge pins 18 for the cover sections 4. The sidewalls 110 are connected by a top wall 112 and a back wall 114. The top wall 112 extends inwardly from the back wall 114 to a vertical entrance plate 116 (FIG. 2) which is located along the end of the feed opening O and abuts against one wall of the feed hopper F. The back wall 114 is offset outwardly from the end wall 12 of the base 2 and extended downwardly therefrom are hinge arms 118 which are attached to the base 2 by the hinge pins 18. Immediately above the pivot brackets 42 on the base 2, a slightly inclined cross wall 120 extends through the cover section 4, from one sidewall 110 to the other.

Located directly above the cross wall 120 is a breaker plate mount 122 which pivots on a cross shaft 124 extended between the sidewalls 110. Secured to the inwardly presented face of the pivoted mount 122, that is, the face presented toward the rotor R, is a flat breaker plate 126 formed preferably from manganese steel. The lower end of the breaker plate 126 aligns with the upper end of the grate section 80 such that the inwardly presented faces of the two are generally flush. Upwardly from the grate section 80, the breaker plate 126 diverges from the hammer circle C. The precise position of the breaker plate 126 is determined by jack screws 127 which are mounted on the cross wall 120 and bear against the pivoted mount 122 below the cross shaft 124.

Directly above the pivoted breaker plate mount 122 is a deflecting vane mount 128 (FIG. 2) which is fixed firmly on a cross shaft 130 extended through it and also through bearings in the sidewalls 110 of the cover section 4. The pivoted mount 128 carries a wear plate 132 which generally occupies the space between the breaker plate 126 and the vertical entrance plate 116. Actually, the upper end of the wear plate 132 is located slightly outwardly from the vertical entrance plate 116, while the lower end is located directly above the breaker plate 126. This enables the lower end of the wear plate 132 to swing inwardly toward the rotor R to a deflecting position wherein it will deflect windage from the rotor R away from feed opening O, assuming that the rotor R is revolving in the clockwise direction (FIG. 2 — left wear plate 132). In effect, a diversion channel is created between the plates 126 and 132, and the windage which is so deflected is directed into a diversion chamber 134 located outwardly from the breaker plate 126. The diversion chamber 134 is vented through the back wall 114. The back side of the mount 128 is oblique to the wear plate 132 and is protected with a relatively thin liner 136. This liner is presented generally downwardly when the wear plate 132 is in its deflecting position. One end of the cross shaft 130 is fitted with an actuating arm 138 to which a hydraulic cylinder 140 is attached.

Within the cover section 4, those portions of the sidewalls 110 which are located inwardly from the wear plate 132 and breaker plate 126 are covered with liners 142 (FIG. 2) made preferably from manganese steel. Also, the triangular portion of the feed hopper H, which are disposed between the sidewalls 110 of the two cover sections 4 and 6, are protected with liners 144.

Figure 2:
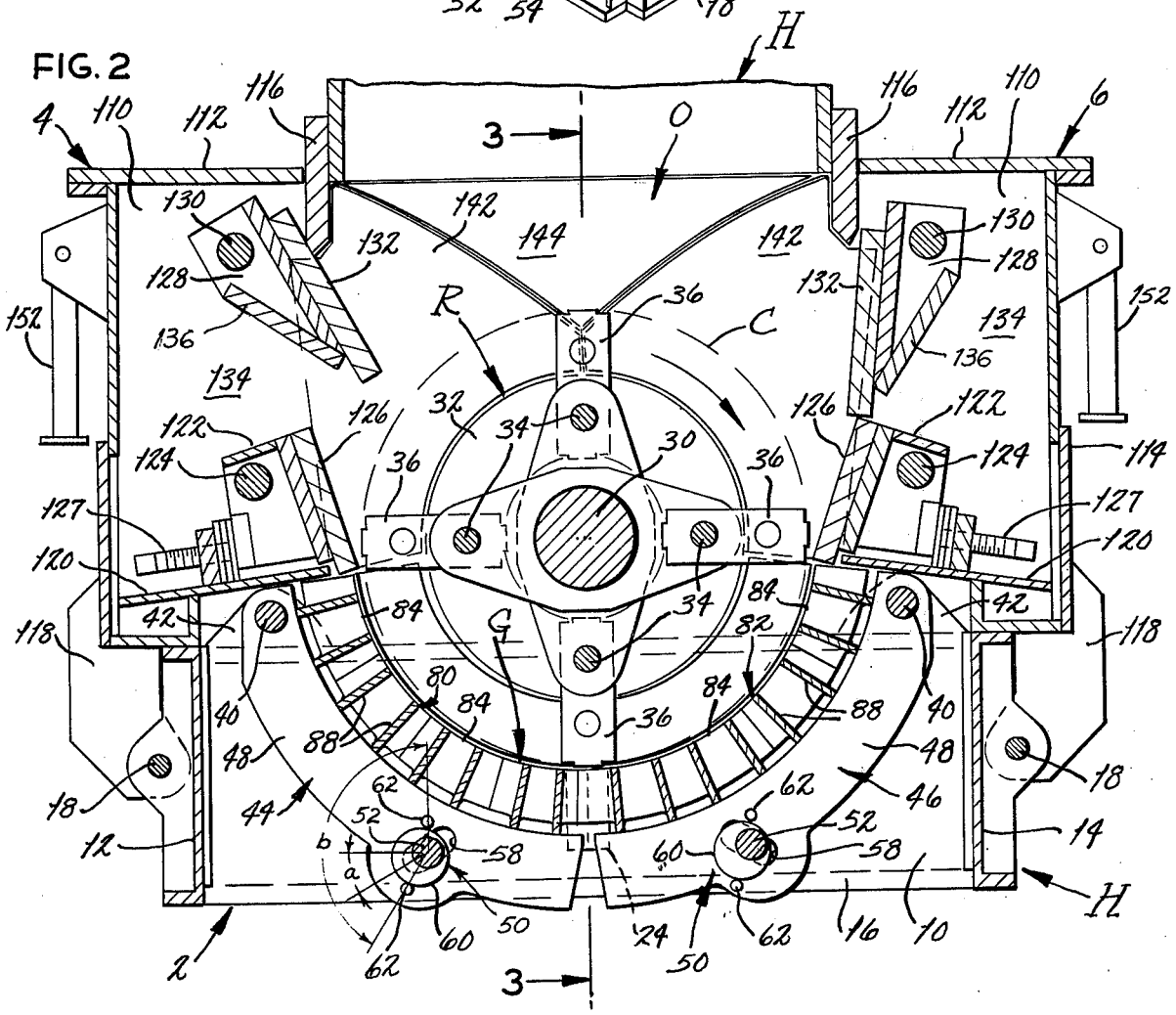
FIG. 2 is a sectional view taken along line 2—2 of FIG. 1 and showing the interior of the machine in elevation.

Along the sidewalls 110 of the two cover sections 4 and 6 a hydraulic cylinder 150 spans those cover sections (FIG. 1). Normally, the two cover sections 4 and 6 are bolted securely to the base 2 so that they cannot be lifted upwardly. However, when the bolts securing one of the cover sections 4 or 6 are removed and the cylinder 150 is energized, that cover section will pivot outwardly about its hinge pins 18 and swing away from the rotor R. The cover section swings outwardly to a fully opened position wherein the short supporting legs 152 (FIG. 2) near the top wall 122 engage the floor on which the base 2 rests. When the cover section is in its fully opened position, the rotor R is exposed for repair, and indeed the entire rotor R may be removed with only one cover section 4 or 6 open. The other cover section is moved to its open position in a like manner.

OPERATION

Prior to introducing refuse into the feed hopper H, the direction of rotation for the rotor R is selected, and then the hydraulic cylinder 140 for the cover section 4 or 6 through which the hammers 36 ascend is energized to project the wear plate 132 controlled by that cylinder 140 into its deflecting position. For example, if the rotor R is to revolve clockwise (FIG. 2) the cylinder 140 on the cover section 4 is energized to pivot the wear plate 132 of the section 4 inwardly toward the rotor R. The windage generated by the rotor R is therefore discharged into the diversion chamber 134 of the cover section 4 instead of into the feed hopper F.

Once the rotor R is brought up to operating speed, refuse is introduced into the machine A through the feed hopper F and feed opening O. This refuse is engaged by the rapidly revolving hammers 36 which hurl at least some of it against the closed wear plate 132 and the breaker plate 126 where brittle objects may shatter. The hammers 36 further draw the refuse into the converging space between the hammer circle C and breaker plate 126 where it is reduced somewhat and thereafter the hammers 36 drag the refuse over the grates 80 and 82 where it is reduced still further. Indeed, the refuse is reduced to a size which enables it to pass through the rectangular openings 92 and 96 in the grate sections 80 and 82. Any tramp iron which fails to pass through the gate sections 80 and 82 is hurled upwardly along the breaker plate 126 on the opposite side of the housing H, and this tramp iron will pass into the diversion chamber 134 through the space created by the inwardly disposed wear plate 132. The airstream or windage generated by the rotor R likewise discharges through that space, and thus the incoming refuse is not blown outwardly through the feed opening O.

The grate sections 80 and 82 are moved upwardly and downwardly to achieve the proper spacing from the hammer circle C by actuating the hydraulic cylinder 72. The cylinder 72, of course, rotates the adjusting shafts 52 which, through the cams 60 thereon, move the lower ends of the cages 44 and 46 upwardly and downwardly depending on the direction of rotation. The precise spacing of the grate sections 80 and 82 from the hammer circle C may be observed through the viewing ports 24 in the sidewalls 10 of the base 2. Since the grate sections 80 and 82 are about one-half as long as conventional grates in the circumferential direction, movement of their lower ends by the cams 60 does not create such large disparities in spacing between the hammer circle and the grate G. The adjustments must be made periodically to compensate for wear of the hammers 36 and the grate bar panels 84.

No gap exists between the two grate sections 80 and 82, even when they are lowered and thereby moved slightly apart, since the teeth 98 on the lowermost panels 84 are staggered and intermesh.

When it is desired to operate the rotor R in the opposite direction so that the hammers 36 wear evenly, the wear plate 132 which was open is closed and the other wear plate 132 is opened to its deflecting position, this being accomplished by energizing the hydraulic cylinders 140.

Figure 3:
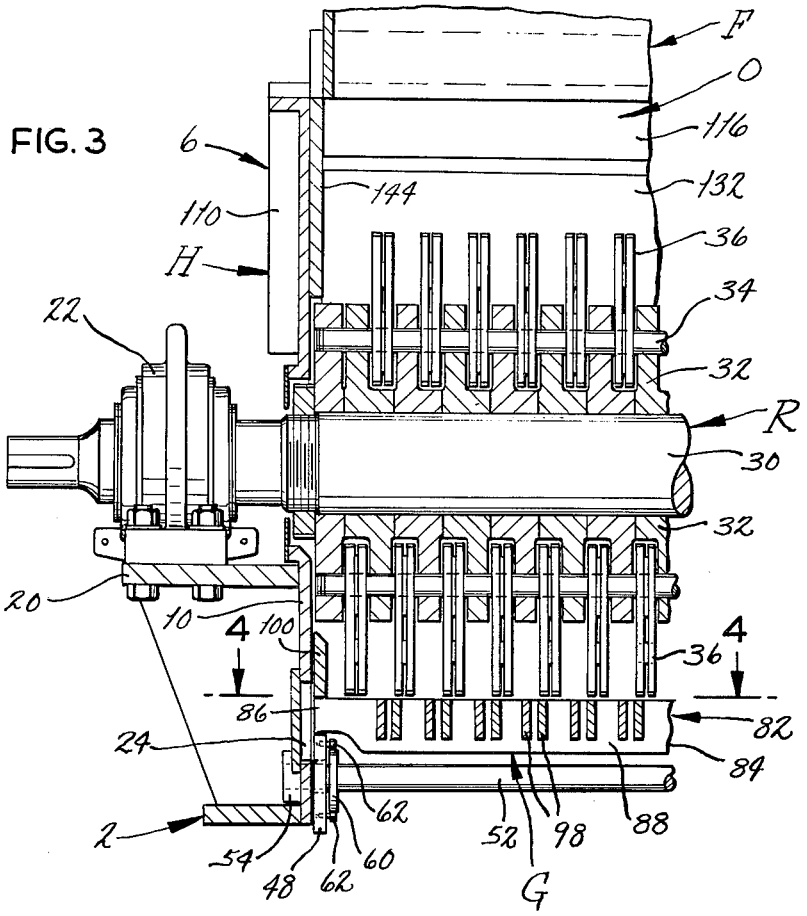
FIG. 3 is a fragmentary sectional view taken along line 3—3 of FIG. 2.

Usually, two machines A are employed in series to effect a primary reduction and a secondary reduction. All refuse including metal passes through the primary machine. Since the hammers 36 of the primary machine are called upon to crush and break as well as shred, they are quite large and heavy. Between the primary and secondary machines the refuse is run through a magnetic separator to remove ferrous metal therefrom. Next, the refuse, with the ferrous metals eliminated, passes through the secondary machine where it is reduced still further, the reduction being to a size suitable for incineration. Since the secondary machine shreds almost exclusively it contains more hammers so as to provide its rotor R with a greater number of cutting edges. This is achieved by positioning two hammers 36 side-by-side between each rotor disk 32 (as illustrated in FIG. 3) instead of one hammer 36. Finally, the refuse passes through another separator which removes non-ferrous metals and glass.

The movable wear plates 132 on each side of the rotor R are generally speaking suitable for use with only reversible machines, for their would be no point in having the wear plates 132 movable in an unidirectional machine. However, the grate 78 which comprises the two movable sections 82 and 84 having the intermeshing teeth 98 is suitable for use with both reversible and unidirectional machines.

While the machine A has been described in conjunction with a refuse shredding operation, it may be used for other shredding operations as well as for crushing and pulverizing. In general, it is suitable for use in a wide variety of reducing operations of the type normally associated with hammermills.

This invention is intended to cover all changes and modifications of the example of the invention herein chosen for purposes of the disclosure which do not constitute departures from the spirit and scope of the invention.

What is claimed is:

1. A reducing machine comprising: a housing having a feed opening; a rotor in the housing and having reducing elements thereon which contact material introduced through the feed opening, the elements describing a circle as the rotor revolves; first and second arcuate grate sections generally beneath the circle, the second grate section being aligned with and forming a continuation of the first grate section in the direction of rotation for the rotor, each grate section having teeth which project toward the other grate section with the teeth of the two grate sections being offset and intermeshed so as to eliminate a continuous gap between the grate sections; first and second cages supporting the first and second grate sections, respectively, each of the cages extending upwardly beneath its respective grate section and at its upper end being pivoted relative to the housing about an axis parallel to the axis of rotation for the rotor to enable the grate sections on the cages to be moved toward and away from the circle described by the reducing elements while the teeth of the two grate sections remain intermeshed; and adjusting means for moving the grate sections toward and away from the circle described by the reducing elements, the adjusting means comprising a shaft extended through the housing adjacent to each cage and being rotatable about an axis fixed in position with respect to the housing, cams carried by the shafts and engaged with the cages, and means for rotating the shafts in unison to cause the grate sections to elevate or depress, depending on the direction of rotation for the shafts.

2. A reducing machine according to claim 1 wherein the cams are circular and eccentric to the shafts on which they are mounted.

3. A reducing machine according to claim 2 and wherein the adjusting means further comprises followers on the cages for engaging the peripheries of the cams, there being at each cam one follower directly above the axes for the shaft and another follower displaced between 145° and 155° from said one follower.

4. A reducing machine according to claim 1 wherein the shafts extend through the cages and the cages are provided with elongated apertures for receiving the shafts and for accommodating movement of the cages.

5. A reducing machine comprising: a housing having a feed opening which opens upwardly; a rotor mounted in the housing for rotation therein about an axis which is fixed in position with respect to the housing, the rotor having reducing elements thereon which contact the material introduced through the feed opening, the reducing elements describing a circle as the rotor revolves; first and second arcuate grate sections having openings therein through which reduced material will pass, the grate sections having upper ends located to the sides of the circle and lower ends located below the circle with the grate sections being aligned but detached from one another at their lower ends, the first grate section at its lower end having teeth which project toward the second grate section and the second grate section at its lower end having teeth which project toward the first grate section, the teeth of the two grate sections being offset from one another and being intermeshed so that a continuous gap does not exist between the lower ends of the grate sections, the teeth of the two grate sections further being narrow enough to create within the grate more openings through which reduced material may pass; mounting means in the housing for positioning the first and second grate sections along the circle described by the reducing elements, the mounting means enabling each grate section to pivot about an axis which is located adjacent to its upper end, is fixed in position with respect to the housing, and is parallel to the axis of the rotor, so that the grate sections may be moved toward and away from the circle and in so doing their lower ends move toward and away from each other while the teeth remain intermeshed; and adjusting means for moving the grate sections toward and away from the circle.

6. A reducing machine according to claim 5 wherein the mounting means comprises first and second cages which extend beneath the first and second grate sections, respectively, the cages at their upper ends pivoting about the axes at the upper end of the grate sections, and wherein the adjusting means contacts the cages at their lower ends.

7. A reducing machine according to claim 6 wherein the adjusting means comprises shafts in the housing, there being a separate shaft beneath each cage, and cams on the shafts, the cams being engaged with the lower ends of the cages and being configured such that when the shafts rotate, the cages are pivoted about the axes at the upper ends of the grate sections.

* * * * *